US006845929B2

(12) United States Patent
Dolatabadi et al.

(10) Patent No.: US 6,845,929 B2
(45) Date of Patent: Jan. 25, 2005

(54) HIGH EFFICIENCY NOZZLE FOR THERMAL SPRAY OF HIGH QUALITY, LOW OXIDE CONTENT COATINGS

(76) Inventors: Ali Dolatabadi, 66 Broadway Ave. Apt. #904, Toronto Ontario (CA), M4P 1T6; Javad Mostaghimi, 1698 Kentchester Place, Mississauga Ontario (CA), L5N 7S7; Valerian Pershin, 49 Mineola Rd. East, Mississauga Ontario (CA), L5G 2E4

( * ) Notice: Subject to any disclaimer, the term of this patent is extended or adjusted under 35 U.S.C. 154(b) by 129 days.

(21) Appl. No.: 10/103,138

(22) Filed: Mar. 22, 2002

(65) Prior Publication Data

US 2003/0178511 A1 Sep. 25, 2003

(51) Int. Cl.[7] ..... A62C 31/02; B05B 1/00; B05B 1/24; F23D 11/38; F23D 14/48

(52) U.S. Cl. ..... 239/589; 239/81; 239/79; 239/601

(58) Field of Search ..... 239/589, 81, 79, 239/601, 590, 590.3, 597, 80, 82–85

(56) References Cited

U.S. PATENT DOCUMENTS 3,064,114 A 11/1962 Cresswell
3,077,108 A 2/1963 Gage et al.
3,823,302 A * 7/1974 Muehlberger ..... 219/121.47
4,004,735 A * 1/1977 Zverev et al. ..... 239/79
4,688,722 A * 8/1987 Dellassio et al. ..... 239/81
4,741,286 A 5/1988 Itoh et al.
5,041,713 A * 8/1991 Weidman ..... 219/121.51
5,217,746 A * 6/1993 Lenling et al. ..... 427/450

FOREIGN PATENT DOCUMENTS

FR 2758476 7/1998

* cited by examiner

*Primary Examiner*—Michael Mar
*Assistant Examiner*—Darren Gorman
(74) *Attorney, Agent, or Firm*—Lynn C. Schumacher; Hill & Schumacher

(57) ABSTRACT

The present invention provides a spray gun with associated nozzle attachments for high deposition efficiency for thermal spray of high quality, dense, low oxide content coatings. The spray guns are used to produce coatings using a thermal spray process, a high velocity oxy-fuel process, a high velocity air-fuel process, cold spraying, and plasma spraying in which the process is characterized by having an over-expanded flow with a Mach number from about 1.0 to about 4.0 which have passageway section which diverges to the gun outlet. In one embodiment the nozzle attachment is another diverging section with a greater angle of divergence than the diverging nozzle section. In another embodiment the nozzle attachment includes the aforementioned diverging nozzle attachment section followed by a converging nozzle section having an outlet section through which the thermal spray is emitted.

16 Claims, 8 Drawing Sheets

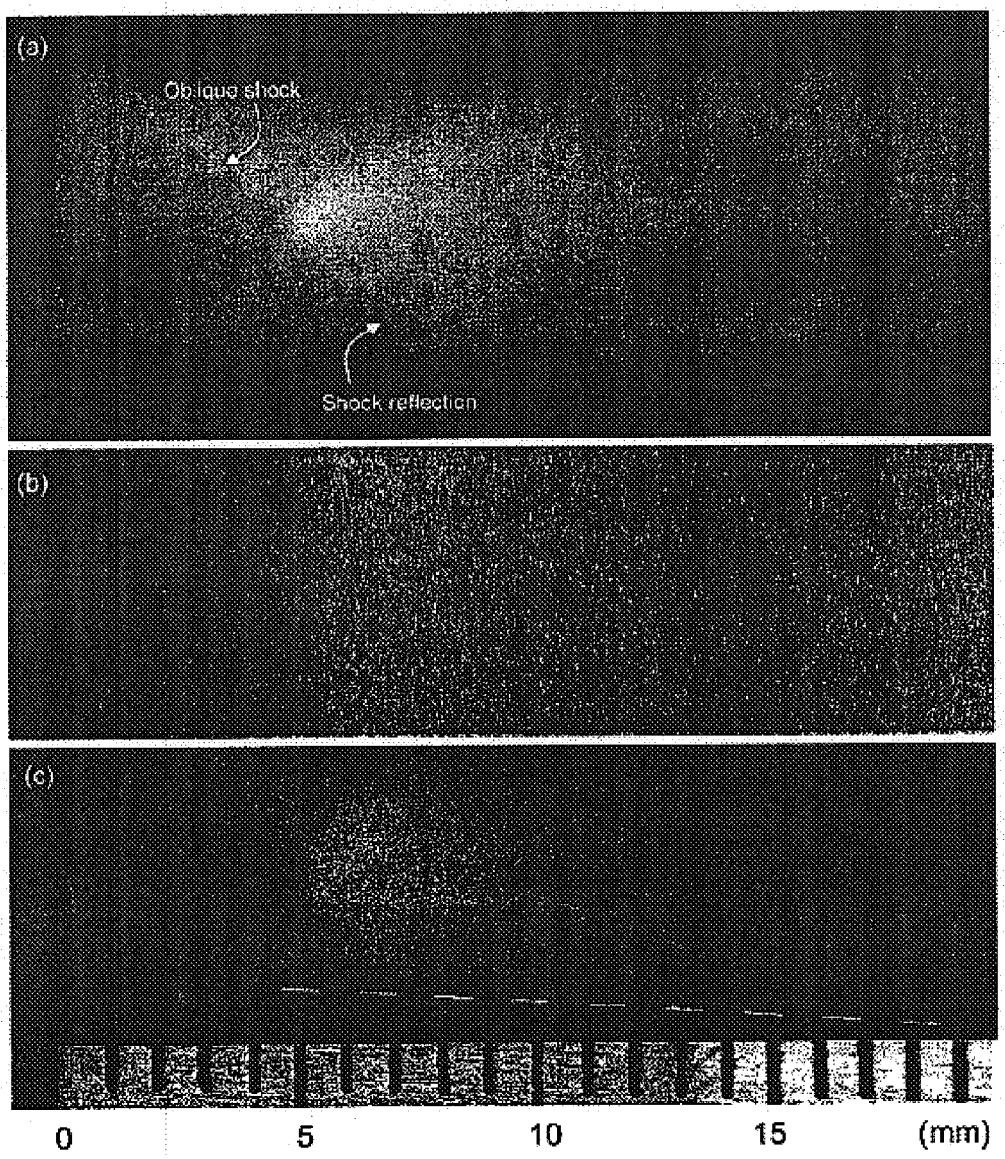
Figure 3 (a) First shock without particle injection, (b) $ZrO_2$ powder, (c) glass powder PRIOR ART

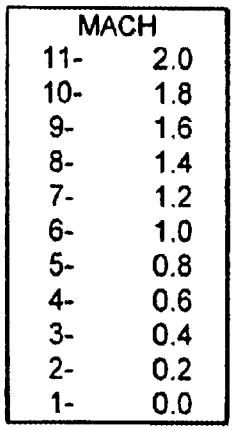
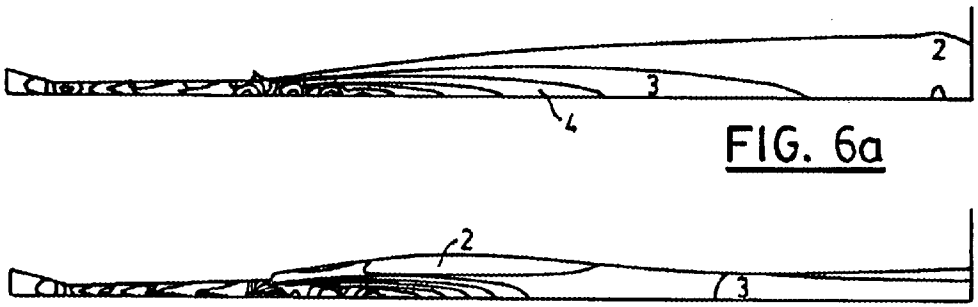
FIG. 6a
FIG. 6b
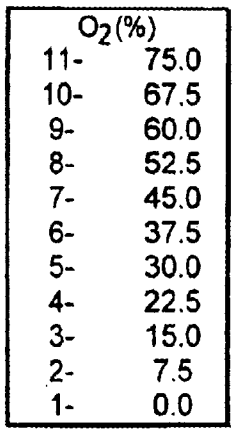
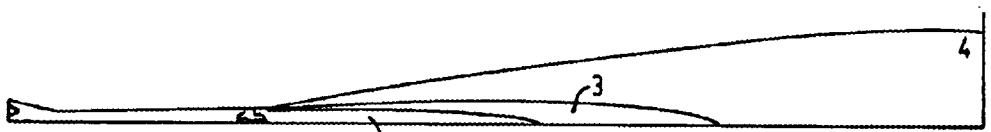
FIG. 7a
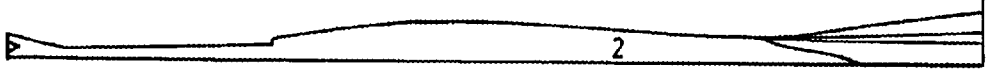
FIG. 7b (a)
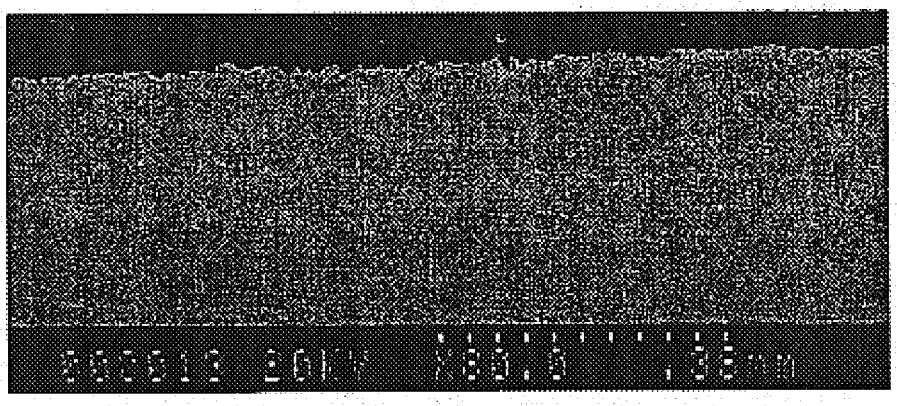
(b)
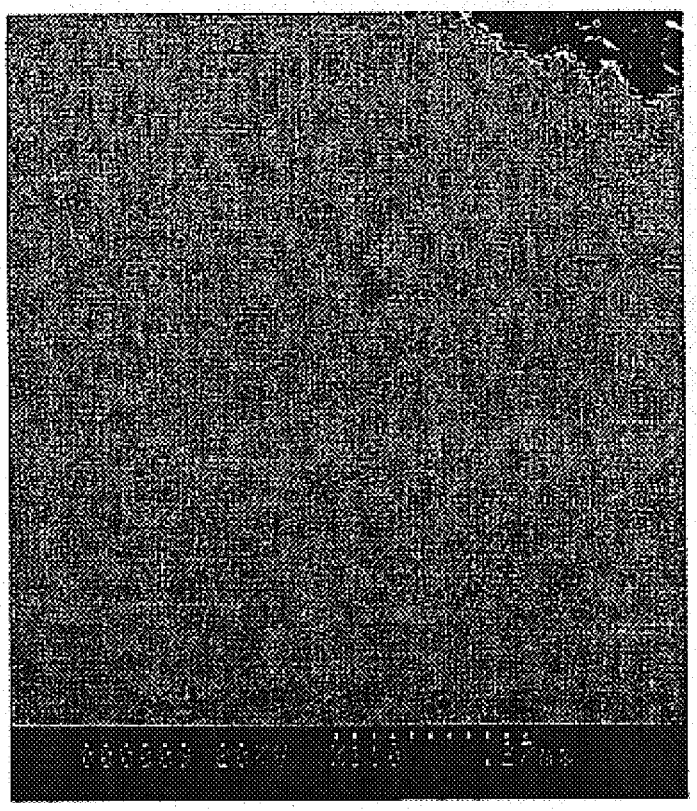
Figures 8a and 8b show coating microstructure with; Figure 8(a) Diverging, Figure 8(b) Diverging-converging nozzle (a)
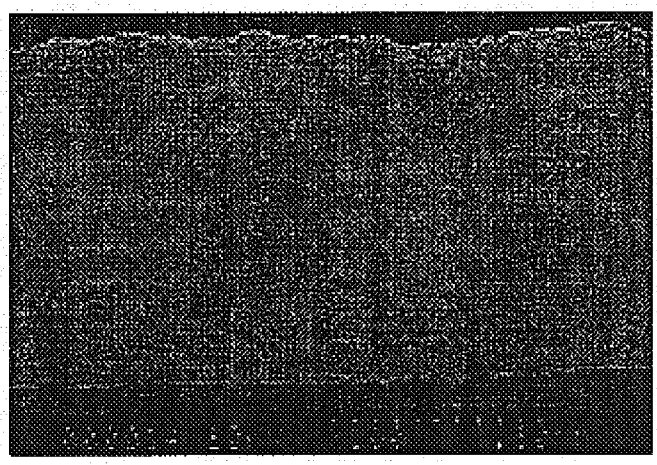
(b)
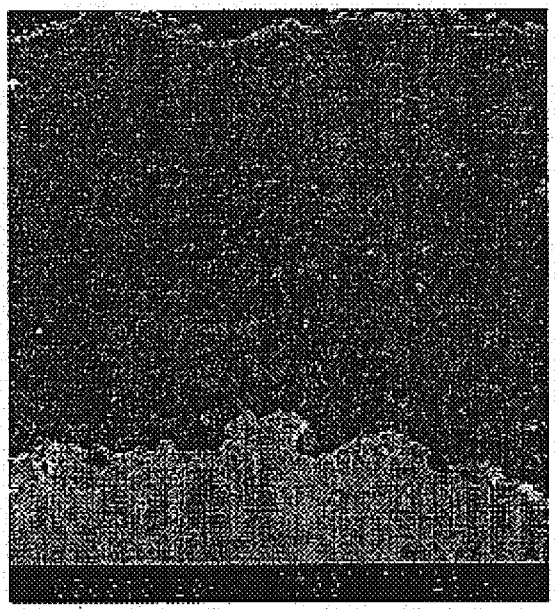
Figures 9a and 9b show $Al_2O_3$ coating microstructure with different magnifications

HIGH EFFICIENCY NOZZLE FOR THERMAL SPRAY OF HIGH QUALITY, LOW OXIDE CONTENT COATINGS

FIELD OF THE INVENTION

This invention relates to a high deposition efficiency nozzle for thermal spray of high quality, dense, low oxide content coatings.

BACKGROUND OF THE INVENTION

Thermal spray coatings are formed by the impact and solidification of a stream of molten or semi-molten particles on a surface. The process combines particle acceleration, heating, melting, spreading and solidification in a single operation. Extensive use is made of thermal spraying in the aerospace, power generation and more recently in automotive industries to provide protective coatings on components that are exposed to heat, corrosion, and wear. Over the last decade, high velocity oxy-fuel process (HVOF) has been demonstrated to be one of the most efficient techniques to deposit high performance coatings at moderate cost. In this process, a mixture of fuel and oxygen ignites in a high pressure combustion chamber and the combustion products are accelerated through a converging-diverging nozzle such as that shown in FIG. 1. As a result, injected particles attain high velocity (above 400 m/s) at relatively low temperature (less than 2000° C.).

Referring again to FIG. 1, the HVOF gun is basically a converging-diverging nozzle to accelerate the gas flow to supersonic speeds at the gun exit. At the end of the gun, the flow is over expanded i.e. the Mach number is greater than one and gas pressure is lower than that of the ambient atmosphere. Because the flow is supersonic, the adjustment to the atmospheric pressure is through waves, oblique shocks or expansion waves. To reach ambient pressure the gases undergo a series of oblique shocks and expansion waves, which is called "shock diamonds". Formation of the first shock diamond is shown in FIG. 2. This pattern will be repeated till the gas pressure reaches to the ambient pressure. In a typical HVOF process, seven to nine shock diamonds form in the ambient air.

A major technological advance achieved with the HVOF gun and process is to generate supersonic flows by which particles can reach high velocities. The reason is that for highly compressible flows the relative velocity between gas and particle can be greater than the local speed of sound. In this case, the compression shocks forming in front of the particles can accelerate particle to higher velocities (wave drag effect). This happens inside the gun where almost a uniform flow exists at each cross sectional area of the gun. Outside the gun, characteristic of the external flow becomes totally different from that of the internal flow, because of presence of a series of shock diamonds outside the gun.

Coating particles gain kinetic and thermal energy form the gas flow. Therefore, particle conditions (e.g. particle velocity, temperature, and trajectory) are a strong function of gas flow behaviour. Particles continuously accelerate inside the gun, whereas outside the gun they face several shocks and expansion waves. As a result, particles repeatedly (up to ten times) are accelerated and decelerated while passing through the external flow. Particles also deviate from their trajectory (which is along the nozzle centreline) because of the oblique shocks. The combination of these two effects causes some particles to not reach the critical velocities required for sticking to the substrate and become dispersed outside the gun. Consequently, the coating deposition efficiency and quality will be decreased. In practice, on the average, 50 percent of the coating particles fed to the HVOF gun are deposited on the substrate. This relatively low deposition efficiency of the HVOF spraying systems can be the result of having many particles among the particulate flow with velocities smaller than the critical velocity. The interaction of oblique shock and expansion wave with solid particles is shown in FIG. 3.

Another drawback of the current HVOF nozzle design of FIG. 1 relates to the degree of oxidation of in-flight particles. While high particle kinetic energy upon impact leads to formation of a dense, well-adhered coating, in contrast, low temperature prevents the in-flight particles from extensive oxidation resulting in coatings with lower oxygen content. Any thermal spray process in ambient atmosphere is accompanied by air entrainment which results in in-flight metal particle oxidation. It is recognized that minimizing oxidation during the coating operation results in improvement of overall coating performance. Vacuum plasma spraying (VPS) allows one to reduce or eliminate oxygen in the spraying region and provides oxide-free coatings, but this process is expensive, time consuming and has restriction on the size of coated parts by the size of the vacuum chamber. Compared to other spraying processes, oxidation rate during the HVOF spraying is one of the lowest and under certain conditions, it is comparable with that of the VPS coatings. In order to use the HVOF process as a technological alternative to the cost intensive VPS process, air entrainment should be minimized.

A further drawback of the present HVOF deposition gun relates to the types of materials that can be deposited. Due to the low flame temperatures, HVOF cannot be used for ceramic coatings. It is primarily used in spraying metals or carbides with metallic binders.

Although the HVOF process has shown to be a technological alternative to the many conventional thermal spray processes, it would be very advantageous to provide a deposition nozzle that provides improved performance in the areas of deposition efficiency, coating oxidation, and flexibility to allow coating of ceramic powders.

SUMMARY OF THE INVENTION

An object of the present invention is to provide a spray gun apparatus for spray coatings by a thermal spray process, including HVOF, high velocity air-fuel (HVAF), cold spraying, and plasma spraying. The spray guns disclosed herein provide improved deposition efficiency in part by very advantageously significantly reducing or eliminating the shock diamonds and air entrainment which reduce deposition efficiency, and increase in-flight particle oxidation.

Another object of the present invention is to provide nozzle attachments which can be retrofitted to commercial plasma guns which give a more uniform plasma emitted from the combination of gun and nozzle attachments which reduce or eliminating the shock diamonds and air entrainment which reduce deposition efficiency, and increase in-flight particle oxidation.

In one aspect of the invention there is provided a spray gun apparatus for a spray coating process, comprising:

an elongate housing defining a longitudinal axis and having opposed ends with an inlet at one of said opposed ends and an outlet at the other of said opposed ends, said elongate housing including a passageway along said longitudinal axis and extending from said inlet to said outlet, said passageway converging for a first selected distance from said inlet and then diverging for a second selected distance along said passageway with a first angle of divergence $\alpha$, and said passageway diverging to said outlet with a second angle of divergence $\beta$ with $\beta>\alpha$.

In this aspect of the invention the first angle of divergence $\alpha$ may be in a range of $0<\alpha<10°$, and the second angle of divergence may be in a range $9.0°<\beta<14.0°$.

In another aspect of the invention there is provided a spray gun apparatus for a spray coating, comprising:

an elongate housing defining a longitudinal axis and having opposed ends with an inlet at one of said opposed ends and an outlet at the other of said opposed ends, said elongate housing including a passageway along said longitudinal axis and extending from said inlet to said outlet, said passageway converging for a first selected distance from said inlet and then diverging for a second selected distance along said passageway with a first angle of divergence $\alpha$, said passageway diverging for a second selected distance with a second angle of divergence $\beta>\alpha$, and said passageway being one of a non-converging straight passageway and a converging passageway with an angle of convergence $\omega$.

In this aspect of the invention the first angle of divergence $\alpha$ may be in a range $0<\alpha<10.0°$, and the second angle of divergence may be in a range $9.0°<\beta<14.0°$, and the angle of convergence $\omega$ may be in a range $0<\omega<10.0°$.

In another aspect of the invention there is provided an improvement in a spray gun apparatus, the apparatus including a spray gun comprising an elongate housing defining a longitudinal axis and having opposed ends with an inlet at one of said opposed ends and an outlet at the other of said opposed ends, said elongate housing including a passageway along said longitudinal axis and extending from said inlet to said outlet, said passageway having a first passageway section which converges for a first selected distance from said inlet and a second passageway section which diverges for a second selected distance along said passageway with a first angle of divergence $\alpha$, the improvement in the spray gun apparatus being characterized by:

a third passageway section which diverges toward said outlet with a second angle of divergence $\beta>\alpha$.

The present invention also provides an improvement in a spray gun apparatus for a spray coating process, the apparatus including a spray gun comprising an elongate housing defining a longitudinal axis and having opposed ends with an inlet at one of said opposed ends and an outlet at the other of said opposed ends, said elongate housing including a passageway along said longitudinal axis and extending from said inlet to said outlet, said passageway having a first passageway section which converges for a first selected distance from said inlet and a second passageway section which diverges for a second selected distance along said passageway with a first angle of divergence $\alpha$, the improvement in the spray gun apparatus characterized by:

a third passageway section which diverges for a third selected distance with a second angle of divergence $\beta>\alpha$, and a fourth passageway section having one of a non-converging straight passageway and a converging passageway with an angle of convergence $\omega$ toward said outlet.

In another embodiment of the invention there is provided a nozzle kit for retrofitting to a spray gun apparatus for a spray coating, the spray gun apparatus including a first elongate housing defining a longitudinal axis and having opposed ends with a gun inlet at one of said opposed ends and a gun outlet at the other of said opposed ends, said elongate housing including a passageway along said longitudinal axis and extending from said inlet to said outlet, said passageway converging for a first selected distance from said inlet and then diverging for a second selected distance along said passageway to said gun outlet with a first angle of divergence $\alpha$, the nozzle kit comprising:

a first elongate nozzle section defining a nozzle axis and having opposed ends with a nozzle inlet at one of said opposed ends and a nozzle outlet at the other of said opposed ends, said first elongate nozzle section being adapted to be attached to said first elongate housing with the nozzle inlet abutting said gun outlet with the longitudinal axes of the first housing being colinear with the nozzle axis, said first elongate nozzle section including a diverging passageway extending from said nozzle inlet to said nozzle outlet with a second angle of divergence $\beta$ with $\beta>\alpha$.

In this aspect of the invention the nozzle kit may include a second elongate nozzle section adapted to be attached to, and extend from, said other of said opposed ends, said second elongate nozzle section having one of a non-converging straight passageway and a converging passageway to a second nozzle section outlet with an angle of convergence $\omega$.

BRIEF DESCRIPTION OF THE DRAWINGS

The method of the present invention will now be described by way of example only, reference being had to the accompanying drawings in which:

FIG. 3(*a*) is a photograph of the output of a PRIOR ART HVOF nozzle of FIG. 1 showing the first shock diamond without particle injection, FIG. 3(*b*) is a photograph similar to FIG. 3(*a*) but showing $ZrO_2$ powder being ejected from the nozzle;

FIG. 3(*c*) is a photograph similar to FIG. 3(*b*) but showing glass powder being ejected from the nozzle;

FIG. 4(*b*) is a cross sectional drawing showing a showing a plasma gun fitted with a nozzle attachment having a diverging-converging configuration;

FIG. 4(*c*) is a cross sectional drawing showing a plasma gun having a converging-diverging-diverging-converging passageway configuration produced in accordance with the present invention;

FIG. 5(*b*) is a view along the line A—A of FIG. 5(*a*);

FIG. 5(*c*) is a cross section of a diverging nozzle attachment showing exemplary dimensions for a diverging nozzle which is retrofitted to an HVOF nozzle;

FIG. 5(*d*) is a view along the line B—B of FIG. 5(*c*);

FIG. 6(*a*) shows Mach number contours for a free jet nozzle;

FIG. 6(*b*) shows Mach number contours for a nozzle having the diverging-converging configuration disclosed herein;

FIG. 7(*a*) shows a plot of oxygen concentration for a free jet;

FIG. 7(*b*) shows a plot of oxygen concentration for a diverging-converging nozzle;

FIG. 8(*a*) shows a scanning electron micrograph of a cross section of a coating microstructure produced with the diverging nozzle of FIG. 4(*a*);

FIG. 8(*b*) shows a scanning electron micrograph of a cross section of a coating microstructure produced with the diverging-converging nozzle of FIG. 4(*b*); and FIGS. 9(*a*) and 9(*b*) show scanning electron micrographs with two different magnifications showing the microstructure of ceramic coatings produced using $Al_2O_3$ powders produced by using the diverging-converging nozzle.

DETAILED DESCRIPTION OF THE INVENTION

The design underlying the devices disclosed herein for depositing spray coatings is based on the gas dynamics governing the supersonic flow generated in the HVOF process. Particularly, the basic concept behind the new spray devices is to reduce or substantially eliminate the shock diamonds associated with the standard HVOF nozzles so that the gas flow has a smooth transition from supersonic to subsonic flow upon exiting the nozzle. While the description hereinafter refers to HVOF devices, it will be understood by those skilled in the art that the devices disclosed herein may be used to produce thermal spray coatings by any thermal spray process, including HVOF, high velocity air-fuel (HVAF), cold spraying, and plasma spraying, which produce an over-expanded flow with Mach number from about 1.0 to about 4.0, at the gun exit.

The devices disclosed herein may be produced by either retrofitting nozzle attachments to existing commercial spray guns or they may be produced and sold as a complete spray gun assembly. Three types of spray guns are disclosed herein, a spray gun with a converging-diverging-diverging nozzle configuration as shown in FIG. 4(*a*) or a spray gun with a converging-diverging-diverging-converging nozzle configuration as shown in FIG. 4(*b*), and a spray gun with a converging-diverging-diverging-straight or parallel nozzle configuration (not shown).

Figure 1:
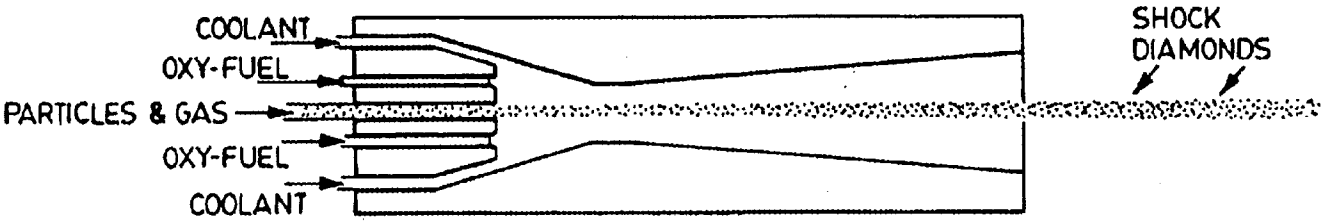
FIG. 1 (PRIOR ART)
FIG. 1 is a schematic diagram of a typical PRIOR ART HVOF nozzle.
Figure 2:
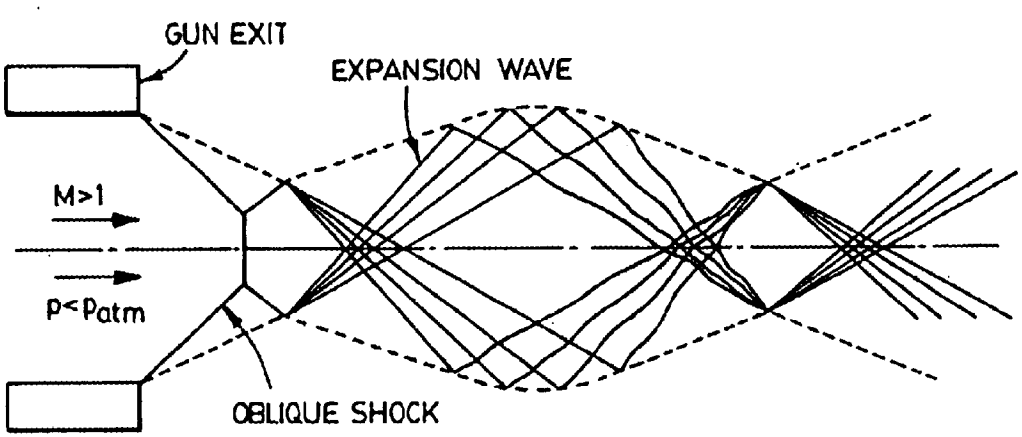
FIG. 2 (PRIOR ART)
FIG. 2 shows the formation of the first shock diamond from the PRIOR ART nozzle of FIG. 1.
Figure 4A:
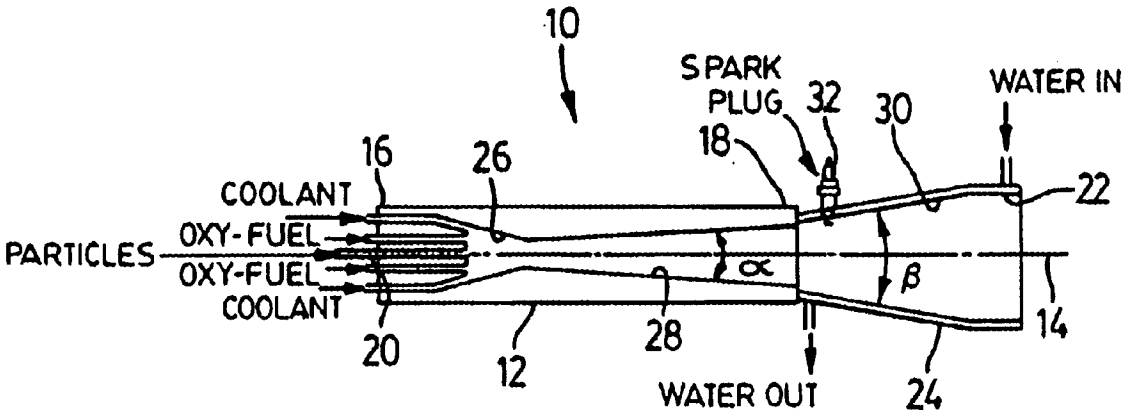
FIG. 4(*a*) is a cross sectional drawing showing a plasma gun fitted with a nozzle attachment with a diverging configuration constructed in accordance with the present invention.
Figure 4B:
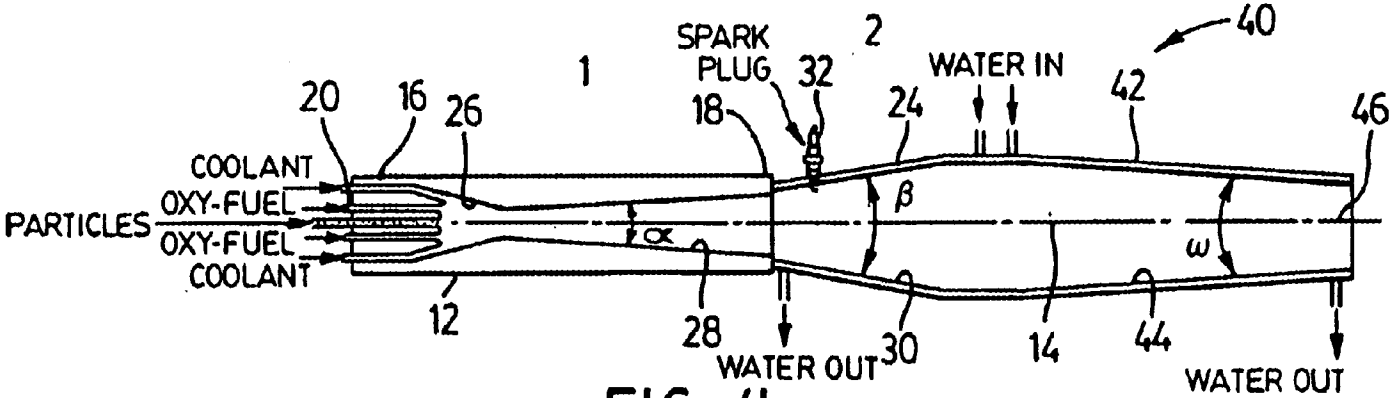
Figure 4C:
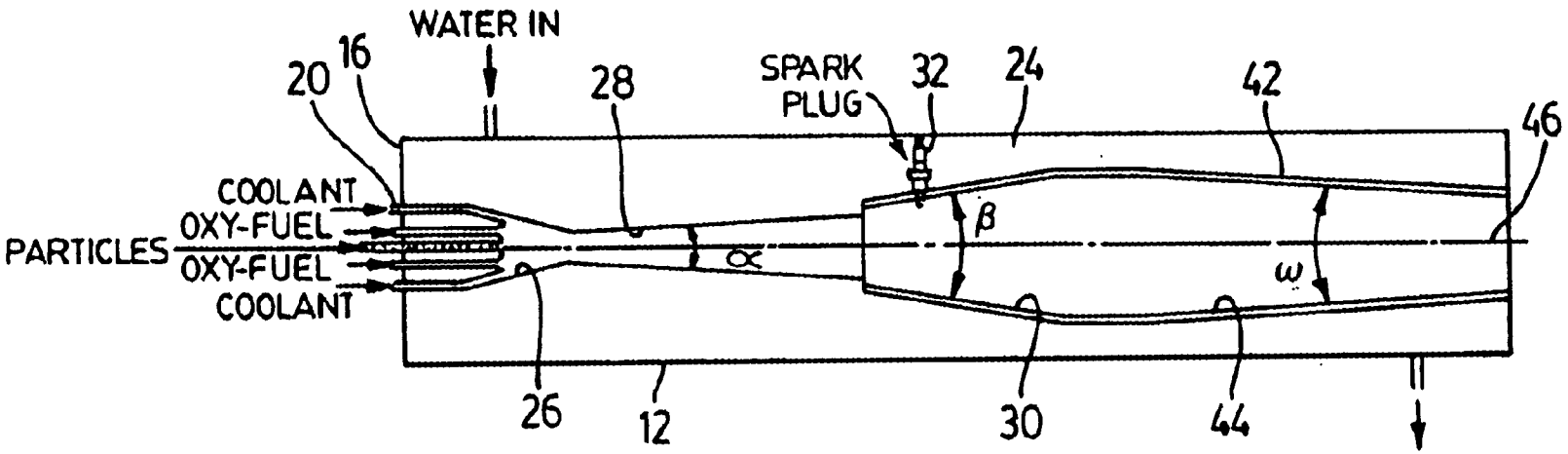
Figure 5A:
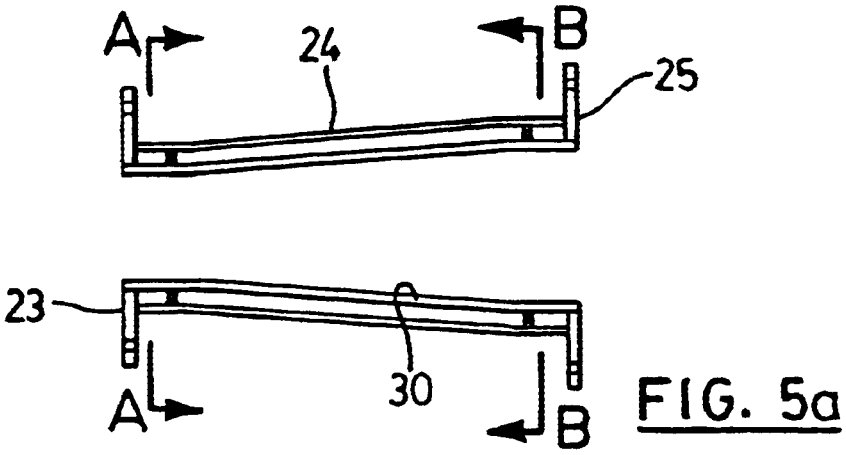
FIG. 5(*a*) is a cross section of a diverging nozzle attachment showing exemplary dimensions for a diverging nozzle which is retrofitted to an HVOF nozzle.
Figure 5C:
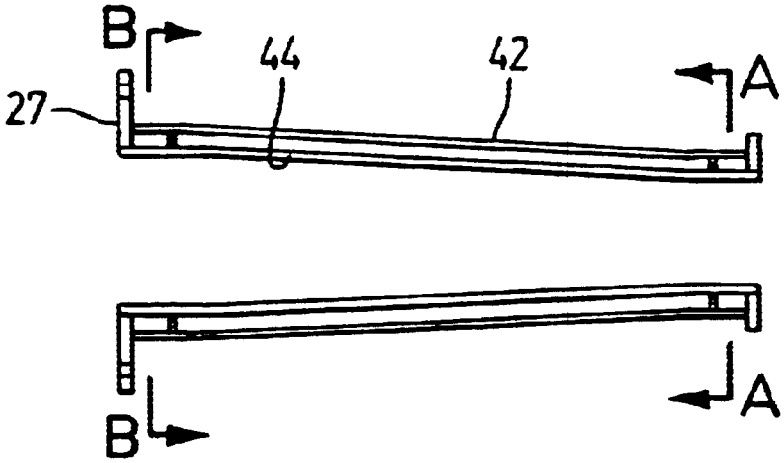
Figure 5B:
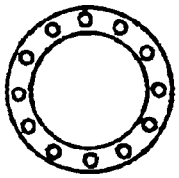
Figure 5D:
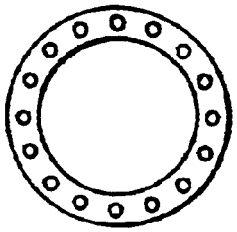

Referring specifically to FIG. 4(*a*), an apparatus for depositing thermal spray coatings shown generally at 10 includes an elongate housing 12 defining a longitudinal axis 14 and having opposed ends 16 and 18. An inlet 20 for gas, particles and fuel is located at end portion 16. The elongate housing 12 includes a passageway extending therethrough along the longitudinal axis 14 from the inlet 20 to the distal end 18. The passageway includes a first section 26 which converges for a first selected distance from end portion 16 and includes a second section 28 which diverges for a second selected distance along the passageway with a first angle of divergence $\alpha$. This diverging section of the passageway terminates at the distal end 18. The apparatus includes a nozzle section 24 which extends from the distal end 18 of housing 12 with nozzle section 24 defining a diverging passageway 30 that diverges to an outlet 22 with a second angle of divergence $\beta>\alpha$. A spark plug 32 in extending through the wall of nozzle section 24 is used to ignite the plasma. The angles $\alpha$ and $\beta$ may be varied. For example, first angle of divergence $\alpha$ may be in the range $0<\alpha<10.0°$ and the angle $\beta$ may vary between $9.0°<\beta<14.0°$. It is noted that $\beta>\alpha$ so that if angle $\alpha$ is equal to 10.0° then $\beta>10.0°$.

When the nozzle sections are being retrofitted to an existing off-the-shelf commercially available spray gun the first angle $\alpha$ will be fixed and therefore the second angle $\beta$ will be chosen to be greater than this pre-selected angle $\alpha$. For example, if a DJ-2700 HVOF gun (produced by Sulzer-Metco Inc, Westbury, N.Y., USA) which has an angle $\alpha$ which is 4°, (essentially shown as item 12 in FIG. 4(*a*)), is to be retrofitted with a diverging nozzle section 24, the angle $\beta$ of divergence of nozzle section 24 may vary between $9.0°<\beta<14.0°$ depending on the operating conditions and powder coating materials. It is noted that in retrofitting commercial spray guns, the angle $\alpha$ is a pre-selected gun specification and may vary from one manufacturer to the other.

Referring to FIG. 4(*b*), an alternative embodiment of an apparatus for depositing thermal spray coatings shown generally at 40 is essentially the same as apparatus of FIG. 4(*a*) but includes a converging nozzle attachment 42 which extends nozzle attachment 24 in FIG. 4(*a*). Nozzle attachment 42 encloses a passageway 44 which either converges to the outlet 46 with an angle of convergence $\omega$ as shown in FIG. 4(*b*) or alternatively the passageway may be straight and parallel and not converge. As discussed with respect to apparatus 10 in FIG. 4(*a*) above, the angles $\alpha$ and $\beta$ in apparatus 40 may be varied. For example, the first angle of divergence $\alpha$ may be in the range $0<\alpha<10.0°$ and the angle $\beta$ may vary between $9.0°<\beta<14.0°$. The angle $\omega$ may vary between $0<\omega<10.0°$. The nozzle sections 24 and 42 in FIGS. 4(*a*) and 4(*b*) are preferably water cooled.

FIGS. 5(*a*) to 5(*d*) show various views of an exemplary, non-limiting example of a diverging nozzle section 24 and a converging nozzle section 42 with dimensions to be retrofitted to a DJ-2700 HVOF gun produced by Sulzer-Metco Inc, Westbury, N.Y., USA. The nozzle section 24 shown in FIGS. 5(*a*) and 5(*c*) include a flange 23 at the narrow end of the nozzle for securing the section to the end portion 18 of housing 12 and a flange 25 at the other wider end of the nozzle section to which flange 27 located on the wider end of nozzle section 42 is secured. The nozzle sections 24 and 42 may therefore be retrofitted to a commercially available spray gun using either nozzle attachment 24 alone or with both attachments 24 and 42 so that they may be sold as a retrofit kit.

Alternatively, entire, unitary one-piece spray guns may be produced corresponding to the embodiments of FIGS. 4(*a*) and 4(*b*). For example, a spray gun could be produced as a unitary one-piece nozzle with converging, diverging, diverging sections from the inlet to the outlet. Similarly, the nozzle of FIG. 4(*b*) could be produced as a unitary one piece nozzle with converging-diverging-diverging-converging passageway sections from the inlet to the outlet, see FIG. 4(*c*).

To evaluate the effect of attaching the new nozzles of FIGS. 4(*a*) to 5(*d*) to an HVOF gun on the coating process, a numerical analysis was performed, prior to the experiments, for the flow characterisation for the conditions with and without the new nozzle. The numerical results are presented in FIGS. 6 and 7. They provide comparison of the main flow features calculated for configurations with and without the new nozzle.

General characteristics of the flow are shown in FIGS. 6(*a*) and 6(*b*). The rapid release of energy near the oxy-fuel inlet causes a high increase in temperature, resulting in a high decrease in density and increase in pressure. This generates high velocities near the inlet. The flow accelerates in the supersonic HVOF gun. Since the flow is supersonic at the gun exit, the characteristics of the flow inside the gun are almost the same for both cases, with and without the new nozzle. The over expanded flow produces shock diamonds outside the gun for the free jet case (FIG. 6(*a*)). When the converging-diverging nozzle attachments 24 and 42 are attached to the gun, the region supersonic flow is extended and transition from supersonic to subsonic flow is no longer through shock diamonds (FIG. 6(*b*)). The new nozzle provides a much smoother transition from supersonic to subsonic flow compared to that of the free jet case. The two effects, removing the shock diamonds and extending the supersonic flow, associated with the flow in from nozzle attachments, results in less particle deviation and more particle acceleration compared to those of the free jet.

In addition, the nozzle attachments provide a shrouding effect to reduce the entrainment of ambient air into the main stream. Shrouding effect on reducing the oxygen concentration is noticeable by comparing FIGS. 7(*a*) and 7(*b*). The oxygen concentration at the spraying position reduces from about 20% for the case of free jet, to less than 5% for the case with the new nozzle attachment. The reduction in oxygen concentration results in smaller oxygen content within the coating. Experimental results for the same operating conditions show the oxygen content in the MCrAlY coating for the free jet case is about 0.4% (by weight), and that of the shrouded case is reduced to 0.12%. Therefore, protecting the main stream from entrainment of the oxygen in the ambient air can significantly reduce the oxide formation in the coating.

In order to study the new nozzle effect on particle conditions, experiments were carried out with the standard operating conditions. In-flight particle conditions such as velocity, temperature and size were measured with a DPV-2000 monitoring system (Tecnar Ltee, Montreal, Canada). The results of measurements at stand-off distances of 8 and 12 inches from the gun exit are shown in tables 1 and 2.

TABLE 1

Particle velocity and temperature at stand-off distance of 8 inches

| | Free Jet | Diverging-converging nozzle |
|---|---|---|
| Particle velocity (m/s) | 576 ± 106 | 736 ± 98 |
| Particle Temperature (° C.) | 2029 ± 159 | 1896 ± 149 |

TABLE 2

Particle velocity and temperature at stand-off distance of 12 inches

| | Free Jet | Diverging-converging nozzle |
|---|---|---|
| Particle velocity (m/s) | 470 ± 72 | 609 ± 76 |
| Particle Temperature (° C.) | 2064 ± 143 | 2034 ± 125 |

As particle velocity shows, the new diverging-converging nozzle increases particle velocities up to 30 percent, which is a key point to produce high density coatings. In addition, the shrouding effect of the new nozzle results in a lower particle temperature. Consequently, using the new nozzle will reduce particle oxidation.

FIGS. 8(*a*) and 8(*b*) show the microstructure of the coatings produced with diverging and diverging-converging nozzle configurations. Coatings applied at stand-off distance of 12 inches. These microstructures show the formation of a dense and well-adhered coating produced using the new nozzle.

Finally, using the new nozzle enables us to apply ceramic coatings with a reasonable deposition efficiency and high quality. FIGS. 9(*a*) and 9(*b*) show the microstructure of the ceramic coatings ($Al_2O_3$ powders) produced by using the diverging-converging nozzle of FIG. 4(*b*).

As used herein, the terms "comprises" and "comprising" are to be construed as being inclusive and open ended, and not exclusive. Specifically, when used in this specification including claims, the terms "comprises" and "comprising" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims.

Therefore what is claimed is:

1. A spray gun apparatus for spray coating, comprising:

an elongate housing defining a longitudinal axis and having opposed ends with an inlet at one of said opposed ends and an outlet at the other of said opposed ends, said elongate housing including a passageway along said longitudinal axis and extending from said inlet to said outlet, said passageway converging for a first selected distance from said inlet and then diverging for a second selected distance along said passageway with a first angle of divergence $\alpha$, and said passageway diverging to said outlet with a second angle of divergence $\beta$ with $\beta>\alpha$, wherein said first angle of divergence $\alpha$ is in a range of $0<\alpha<10°$, and wherein said second angle of divergence is in a range $9.0<\beta<14.0°$.

2. The apparatus according to claim 1 wherein the spray gun apparatus is adapted to produce coatings using a spray process characterised by having an over-expanded flow with a Mach number from about 1.0 to about 4.0 by one of a thermal spray process, high velocity oxy-fuel process, high velocity air-fuel process, cold spraying, and plasma spraying.

3. A spray gun apparatus for a spray coating process, comprising:

an elongate housing defining a longitudinal axis and having opposed ends with an inlet at one of said opposed ends and an outlet at the other of said opposed ends, said elongate housing including a passageway along said longitudinal axis and extending from said inlet to said outlet, said passageway converging for a first selected distance from said inlet and then diverging for a second selected distance along said passageway with a first angle of divergence $\alpha$, said passageway diverging for a third selected distance with a second angle of divergence $\beta>\alpha$, and said passageway being further extended toward said outlet to be one of a non-converging straight passageway and a converging passageway with an angle of convergence $\omega$.

4. The apparatus according to claim 3 wherein said first angle of divergence $\alpha$ is in a range $0<\alpha<10.0°$, and wherein said second angle of divergence is in a range $9.0°<\beta<14.0°$.

5. The apparatus according to claim 4 wherein said angle $\omega$ is in a range $0<\omega<10.0°$.

6. The apparatus according to claim 3 wherein the spray gun apparatus is adapted to produce coatings using a spray process characterised by having an over-expanded flow with a Mach number from 1.0 to 4.0 at the gun exit by one of a thermal spray process, high velocity oxy-fuel process, high velocity air-fuel process, cold spraying, and plasma spraying.

7. An improvement in a spray gun apparatus, the apparatus including a spray gun comprising an elongate housing defining a longitudinal axis and having opposed ends with an inlet at one of said opposed ends and an outlet at the other of said opposed ends, said elongate housing including a passageway along said longitudinal axis and extending from said inlet to said outlet, said passageway having a first passageway section which converges for a first selected distance from said inlet and a second passageway section which diverges for a second selected distance along said passageway with a first angle of divergence $\alpha$, the improvement in the spray gun apparatus being characterized by:

a third passageway section which diverges toward said outlet with a second angle of divergence $\beta>\alpha$, wherein said first angle of divergence $\alpha$ is in a range $0<\alpha<10.0°$, and wherein said second angle of divergence $\beta$ is in a range $9.0°<\beta<14.0°$.

8. The apparatus according to claim 7 wherein the spray gun apparatus is adapted to produce coatings using a spray process characterised by having an over-expanded flow with a Mach number from about 1.0 to about 4.0 by one of a thermal spray process, high velocity oxy-fuel process, high velocity air-fuel process, cold spraying, and plasma spraying.

9. An improvement in a spray gun apparatus for a spray coating process, the apparatus including a spray gun comprising an elongate housing defining a longitudinal axis and having opposed ends with an inlet at one of said opposed ends and an outlet at the other of said opposed ends, said elongate housing including a passageway along said longitudinal axis and extending from said inlet to said outlet, said passageway having a first passageway section which converges for a first selected distance from said inlet and a second passageway section which diverges for a second selected distance along said passageway with a first angle of divergence $\alpha$, the improvement in the spray gun apparatus characterized by:

a third passageway section which diverges for a third selected distance with a second angle of divergence $\beta>\alpha$, and a fourth passageway section having one of a non-converging straight passageway and a converging passageway with an angle of convergence $\omega$ toward said outlet, wherein said first angle of divergence $\alpha$ is in a range $0<\alpha<10.0°$, and wherein said second angle of divergence is in a range $9.0°<\beta<14.0°$.

10. The apparatus according to claim 9 wherein said angle $\omega$ is in a range $0<\omega<10.0°$.

11. The apparatus according to claim 9 wherein the spray gun apparatus is adapted to produce coatings using a spray process characterised by having an over-expanded flow with a Mach number from about 1.0 to about 4.0 by one of a thermal spray process, high velocity oxy-fuel process, high velocity air-fuel process, cold spraying, and plasma spraying.

12. A nozzle kit for retrofitting to a spray gun apparatus for a spray coating, the spray gun apparatus including a first elongate housing defining a longitudinal axis and having opposed ends with a gun inlet at one of said opposed ends and a gun outlet at the other of said opposed ends, said elongate housing including a passageway along said longitudinal axis and extending from said inlet to said outlet, said passageway converging for a first selected distance from said inlet and then diverging for a second selected distance along said passageway to said gun outlet with a first angle of divergence $\alpha$, the nozzle kit comprising:

a first elongate nozzle section defining a nozzle axis and having opposed ends with a nozzle inlet at one of said opposed ends and a nozzle outlet at the other of said opposed ends, said first elongate nozzle section being adapted to be attached to said first elongate housing with the nozzle inlet abutting said gun outlet with the longitudinal axes of the first housing being colinear with the nozzle axis, said first elongate nozzle section including a diverging passageway extending from said nozzle inlet to said nozzle outlet with a second angle of divergence $\beta$ with $\beta>\alpha$; and a second elongate nozzle section adapted to be attached to, and extend from, said other of said opposed ends, said second elongate nozzle section having one of a non-converging straight passageway and a converging passageway to a second nozzle section outlet with an angle of convergence $\omega$.

13. The nozzle kit according to claim 12 wherein said first angle of divergence $\alpha$ is in a range $0<\alpha<10.0°$, and wherein said second angle of divergence is in a range $9.0°<\beta<14.0°$.

14. The nozzle kit according to claim 13 wherein said angle $\omega$ is in a range $0<\omega<10.0°$.

15. The apparatus according to claim 12 wherein the spray gun apparatus is adapted to produce coatings using a spray process characterised by having an over-expanded flow with a Mach number from about 1.0 to about 4.0 by one of a thermal spray process, high velocity oxy-fuel process, high velocity air-fuel process, cold spraying, and plasma spraying.

16. A nozzle kit for retrofitting to a spray gun apparatus for a spray coating, the spray gun apparatus including a first elongate housing defining a longitudinal axis and having opposed ends with a gun inlet at one of said opposed ends and a gun outlet at the other of said opposed ends, said elongate housing including a passageway along said longitudinal axis and extending from said inlet to said outlet, said passageway converging for a first selected distance from said inlet and then diverging for a second selected distance along said passageway to said gun outlet with a first angle of divergence $\alpha$, the nozzle kit comprising:

a first elongate nozzle section defining a nozzle axis and having opposed ends with a nozzle inlet at one of said opposed ends and a nozzle outlet at the other of said opposed ends, said first elongate nozzle section being adapted to be attached to said first elongate housing with the nozzle inlet abutting said gun outlet with the longitudinal axes of the first housing being colinear with the nozzle axis, said first elongate nozzle section including a diverging passageway extending from said nozzle inlet to said nozzle outlet with a second angle of divergence $\beta$ with $\beta>\alpha$, wherein said first angle of divergence $\alpha$ is in a range $0<\alpha<10.0°$, and wherein said second angle of divergence is in a range $9.0°<\beta<14.0°$.

* * * * *